US006709033B2

(12) United States Patent
Jooss et al.

(10) Patent No.: US 6,709,033 B2
(45) Date of Patent: Mar. 23, 2004

(54) DOOR GRIP ARRANGEMENT FOR A VEHICLE DOOR

(75) Inventors: Juergen Jooss, Sindelfingen (DE); Rudi Koelle, Sindelfingen (DE); Martin Lindmayer, Sulz a.N. (DE); Alfred Strauber, Ehningen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/988,400

(22) Filed: Nov. 19, 2001

(65) Prior Publication Data

US 2002/0059693 A1 May 23, 2002

(30) Foreign Application Priority Data

Nov. 17, 2000 (DE) ..... 100 57 019

(51) Int. Cl.[7] ..... E05B 3/00

(52) U.S. Cl. ..... 292/336.3; 292/DIG. 22; 16/472

(58) Field of Search ..... 292/336.3, DIG. 22, 292/347; 16/412

(56) References Cited

U.S. PATENT DOCUMENTS 3,719,248 A * 3/1973 Breitschwerdt ..... 180/112
5,560,659 A * 10/1996 Dault ..... 292/336.3
5,669,642 A * 9/1997 Kang ..... 292/336.3
6,010,167 A * 1/2000 Tanimoto ..... 292/336.3
6,042,159 A 3/2000 Spitzley et al.
6,070,923 A * 6/2000 Tanimoto ..... 292/336.3

FOREIGN PATENT DOCUMENTS

DE 3402914 A1 8/1985
DE 3628376 C2 8/1988
DE 1050640 A2 11/2000

* cited by examiner

*Primary Examiner*—Gary Estremsky
(74) *Attorney, Agent, or Firm*—Crowell & Moring LLP

(57) ABSTRACT

A door grip arrangement for the door of a power vehicle, particularly a passenger vehicle, has a door grip positioned on the outside of the door and a support element positioned on the inside of the door. The door grip is swivel-mounted on the support element through the outer shell of the door, while the door grip exhibits a catch which, upon an opening movement of the door grip, actuates a release lever inside the door in order to open the door lock. The release lever is a part of a door lock positioned within the door. A return lever is swivel-mounted on the support element. The return lever is loaded by a spring device working in the return direction and impelling the door grip to perform a return movement in a direction opposite that of the opening movement. To enhance the safety of a vehicle equipped with a door which exhibits this kind of door grip arrangement, the return lever can swivel against its return direction, independent of any movement of the door grip.

6 Claims, 1 Drawing Sheet

DOOR GRIP ARRANGEMENT FOR A VEHICLE DOOR

BACKGROUND AND SUMMARY OF THE INVENTION

This application claims the priority of German Patent Document 100 57 019.4, filed Nov. 17, 2000, the disclosure of which is expressly incorporated by reference herein.

The present invention relates to a door grip arrangement for the door of a power vehicle, particularly a passenger vehicle.

This kind of door grip arrangement is known from, e.g., German publication DE 36 28 376 C2, and exhibits a door grip positioned on the outside of the vehicle door, as well as a support element positioned on the inside of the door. The door grip is mounted on this support element in swivel fashion through the door's outer shell. The door grip has a catch, which—upon the opening movement of the door grip, specifically upon manual actuation of the grip—actuates a release lever belonging to a door lock positioned in the door, in order to open the lock. Inside of the door, furthermore, a return lever is swivel-mounted on the support element; the return lever is preloaded with spring means acting in the return direction and forces the door grip to execute a return movement in a direction opposite that of the opening movement. In the process, the return lever driving the door grip engages with the catch; here the return lever overlaps with the catch in form-fitting fashion, both on a side facing the door grip and on a side facing away from the door grip. Thus, in the opening movement of the door grip, this compulsory coupling results in the return lever swiveling against its return direction.

However, if an outwardly directed force is exerted on the door grip in an undesired fashion, for example, in the case of a crash, the result could be that the door grip executes the opening movement and opens the door lock at a critical moment. Precisely in the case of crash, however, it is decisively important that the doors of the vehicle remained closed. To guarantee this, return levers in current door grip arrangements are equipped with balance weights which, relative to the swivel axes of the return levers, are positioned opposite couplings with the catches. As a result, outwardly directed accelerating forces, such as those arising during a crash, will be exerted both on the door grip in the opening direction, as well as on the return lever in the return direction, thereby preventing an undesired opening of the door grip, and thus of the door lock, due to the compulsory coupling of the return lever and the catch.

However, in certain crash situations, accelerations are exerted on the return lever, or on its balance weight, thereby driving the return lever against its return direction, that is, in the opening direction. A swivel movement of the return lever is usually prevented, however, by the compulsory coupling with the door grip when corresponding forces are also exerted on the door grip in the closing direction of the door grip. In certain situations, however, the opening forces on the return lever can be greater than the closing forces on the door grip, with the result that, due to the compulsory coupling between the return lever and the catch, the door grip is made to swivel and open the door lock. Situations of this kind may arise in the case of crashes, e.g., when severe accelerations spread in wave-like fashion inside the vehicle and are thus exerted at different moments on the door grip and on the balance weight for the return lever. However, for these situations, there is also a need to avoid the undesired opening of the door lock and the danger of the vehicle door opening during a crash with measures that would increase the safety of the vehicle.

For a door grip arrangement of the initially described type the present invention is concerned with the problem of providing an embodiment that increases the vehicle safety.

This problem is solved by the invention with a particular door grip arrangement for a door of a power vehicle including a door grip positioned on an outside of the door and a support element positioned on an inside of the door. The door grip is swivel-mounted on the support element through the outer shell of the door, and a catch is exhibited by the door grip. Upon opening movement of the door grip, the catch actuates a release lever inside the door in order to open a door lock. The release lever is a part of the door lock positioned within the door, and a return lever is swivel-mounted on the support element. The return lever is loaded by a spring device working in a return direction and impelling the door grip to perform return movement in a direction opposite that of the opening movement.

The present invention is based on the general concept of directly or indirectly coupling the return lever with the door grip in such a way that the return lever can swivel against its return direction independent of a movement of the door grip. This measure assures that the compulsory coupling of the door grip and the return lever only applies when the opening forces operate on the door grip. In this case, due to the compulsory coupling, the opening movement of the door grip brings about a swivel movement of the return lever counter to its return direction. In a different case—that is, when the opening forces operate on the return lever—the latter may swivel against its return direction without moving the door grip in the opening direction. Thus, an undesired opening of the door, particularly in the case of a crash, can also be avoided in cases where the opening forces on the return lever are larger than the closing forces on the door grip. The inventive measure thus allows the vehicle safety to be increased.

According to one advantageous embodiment, the return lever for moving the door grip can engage with the catch, in the process of which the return lever overlaps with the catch, or with a component part of the catch, only on a side facing the door grip. Consequently, at the end of the return lever that is coupled with the catch, the side facing away from the door grip is free or open for the catch or a corresponding coupling element belonging to the catch, with the result that the return lever can move away from the catch without interacting with the catch when the return lever swivels against its return direction. An embodiment of this kind can be realized very simply and therefore inexpensively.

Other important features and advantages of the present invention will be apparent from dependent claims, the drawings, and the corresponding description of the figures, as based on the drawings.

The features referred to above and explained below can be applied not only in the specified combinations, but in other combinations and alone, without departing from the overall framework of the invention.

BRIEF DESCRIPTION OF THE DRAWINGS

A preferred exemplary embodiment of the invention is depicted in the drawings and is described in greater detail below.

DETAILED DESCRIPTION OF THE DRAWINGS

Figure 1:
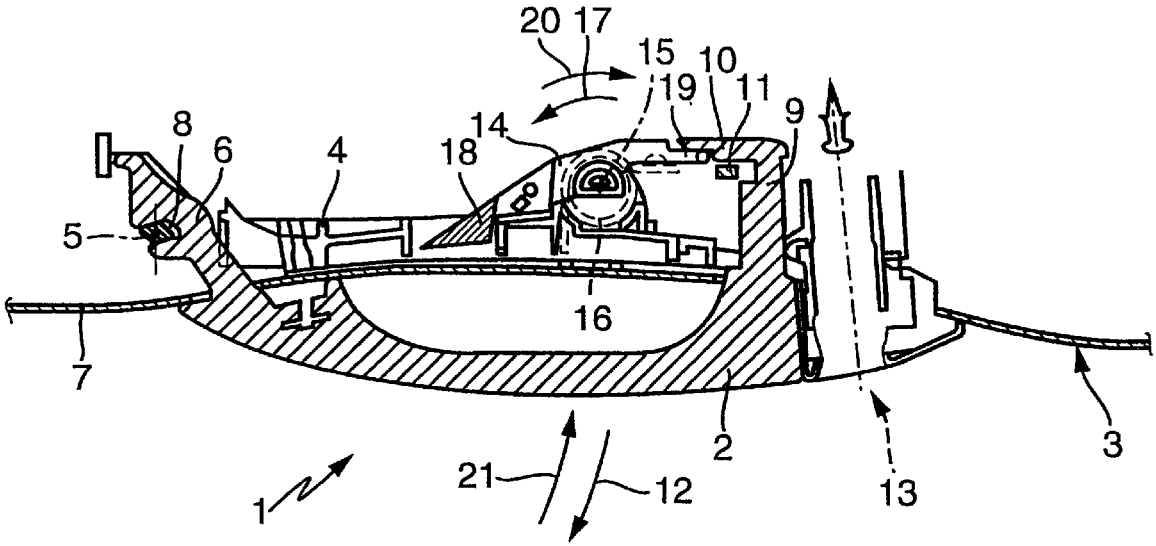
FIG. 1 is a longitudinal section through an inventive door grip arrangement in unloaded condition.
Figure 2:
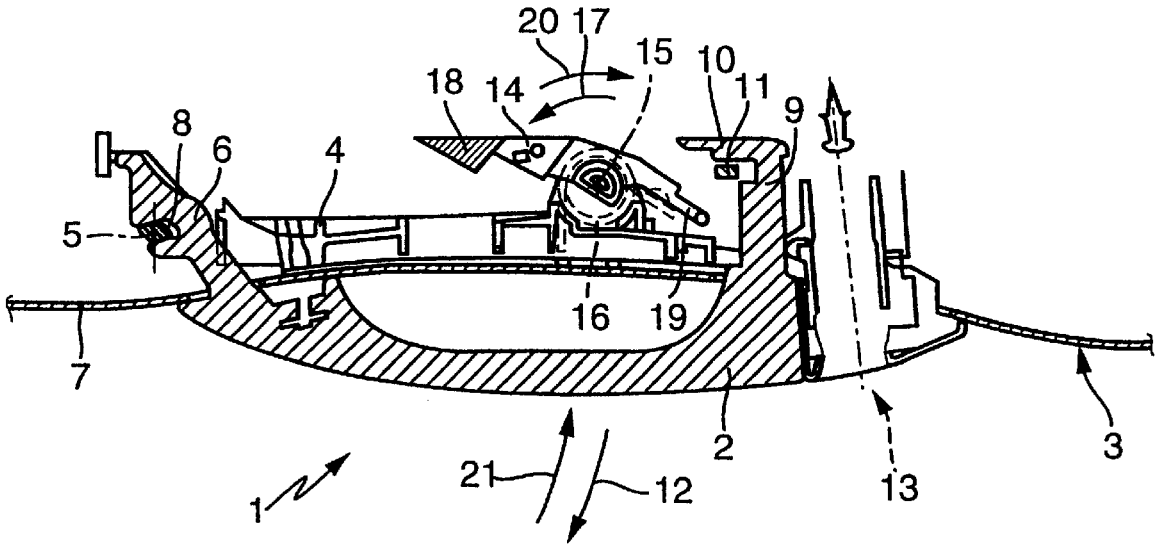
FIG. 2 is a view similar to FIG. 1, but sharing the arrangement in a loaded state, which results in a swivel movement of the return lever belonging to the door grip arrangement.

FIGS. 1 and 2 show an inventive door grip arrangement 1 exhibiting a door grip 2, which is positioned on the outside of an only partially depicted door 3 belonging to a power vehicle (which is not shown), particularly a passenger vehicle. The door grip arrangement 1 also exhibits a support element 4, which is positioned inside of the door 3. On this support element 4 the door grip 2 is swivel-mounted around a swivel axis 5. To this end, there is formed on the door grip 2 a mounting arm 6 which penetrates an outer shell 7 of the door 3 and interacts with a bearing pin 8 belonging to the support element 4 on the inside of the door 3. Here the swivel axis 5 of the door grip 2 runs roughly perpendicular to the plane of the drawing.

Formed on a side of the door grip 2 that is opposite the mounting arm 6 is a catch 9, which also passes through the outer shell 7 of the door 3 and penetrates into the interior of the door 3. At its end opposite the door grip 2 the catch 9 has an angled catch hook 10, which on a side away from the door grip 2 engages with a release lever 11 belonging to a door lock, which is not shown and which is also positioned in the door 3. In an opening movement 12 of the door grip 2, indicated by the arrow and directed outwards, the catch hook 10 pulls the release lever 11 along with it and thereby actuates the latter, so that the door lock is opened.

In addition, a closing cylinder unit 13, which is only suggested here, can also be built in to the door grip arrangement 1.

On the inside of the door 3 a return lever 14 is swivel-mounted around a swivel axis 15 on the support element 4; here the swivel axis 15 of the return lever 14 runs roughly perpendicular to the plane of the drawing. The return lever 14 is loaded with spring means 16 working in a return direction 17 indicated by an arrow; the spring means 16 are suggested by the broken lines. The return lever 14 carries a balance weight 18 on an end facing away from the catch 9. At an end toward the catch 9 there is formed on the return lever 14 a return member 19, which, relative to the swivel axis 15 of the return lever 14, occupies a position opposite that of the balancing weight 18.

As shown in FIG. 1, the return member 19 overlaps with the catch hook 10 on a side facing the door grip 2. With the opening movement 12 of the door grip 2, the catch 9 draws the return member 19 of the return lever 14 along with it by means of the catch hook 10 next to the release lever 11; the catch 9 thus causes the return lever 14 to swivel in an opening direction 20 (also indicated by an arrow), counter to its return direction 17. Because it is spring-loaded, the return lever 14 correspondingly moves the door grip 2 in a closing or return movement 21 by means of the return member 19 and the catch 9; this closing or return movement 21 is indicated by an arrow and runs opposite the opening direction 12.

In accordance with the invention the coupling between the return lever 14 and the door grip 2 is such that the return lever 14 can swivel independent of any movement—and thus also in the absence of movement—on the part of the door grip 2, counter to its return direction 17 and thus in its opening direction 20. In the exemplary embodiment depicted here this is achieved in that the return lever 14 overlaps with the catch 9, or the catch hook 10, with its return member 19 on the side of the catch facing the door grip 2 only, so that on its side facing away from the door grip 2 the return lever 14 is designed to be open or free for the catch 9, or the catch hook 10, that is, without any overlap. Consequently the return lever 14, as shown with FIG. 2, can swivel in the opening direction 20 independent of the door grip 2, in the process of which the return member 19 moves away from the catch hook 10.

With the design according to the invention, a force which drives the return lever 14 in its opening direction 20 will have no effect on the door grip 2 via the return lever 14. Forces of this type can occur under certain circumstances during a crash. In these cases, the return lever 14 can swivel against its return direction 17 independent of the door grip 2, with the result that the door grip 2 remains in its closed position and thus does not actuate the release lever 11 for opening the door lock. Thus, in these special crash cases, it is also possible to guarantee that the door 3 remains locked, thereby increasing the safety of the vehicle.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. A door grip arrangement for a door of a power vehicle, comprising:

a door grip positioned on an outside of the door, a support element positioned on an inside of the door, the door grip being swivel-mounted on the support element through the outer shell of the door, a catch provided on the door grip, said catch, upon opening movement of the door grip, actuating a release lever inside the door in order to open a door lock, said release lever being a part of the door lock positioned within the door, and a return lever swivel-mounted on the support element, said return lever being loaded by a spring device working in a return direction and impelling the door grip to perform return movement in a direction opposite that of the opening movement, wherein the return lever for driving the door grip engages with only one side of the catch facing the door grip.

2. A door grip arrangement for a door of a power vehicle, comprising:

a door grip positioned on an outside of the door, a support element positioned on an inside of the door, the door grip being swivel-mounted on the support element through the outer shell of the door, a catch provided on the door grip, said catch, upon opening movement of the door grip, actuating a release lever inside the door in order to open a door lock, said release lever being a part of the door lock positioned within the door, and a return lever swivel-mounted on the support element, said return lever being loaded by a spring device working in a return direction and impelling the door grip to perform return movement in a direction opposite that of the opening movement, wherein the return lever for driving the door grip engages with only one side of a component part of the catch facing the door grip.

3. A door grip arrangement according to claim 1, wherein the power vehicle is a passenger vehicle.

4. A process of operating a door grip arrangement for the door of a power vehicle having a door grip positioned on an outside of the door and a support element positioned on an inside of the door, the door grip being swivel-mounted on the support element through the outer shell of the door, comprising:

actuating a release lever inside the door in order to open a door lock by way of a catch, provided on the door grip, upon opening movement of the door grip, said release lever being a part of a door lock positioned within the door, and performing a door grip return movement by way of a return lever swivel-mounted on the support element, said return lever being loaded with a spring device working in a return direction and impelling the door grip to perform said return movement in a direction opposite that of the opening movement, wherein the return lever for driving the door grip engages with only one side of the catch facing the door grip.

5. A process of operating a door grip arrangement for the door of a power vehicle having a door grip positioned on an outside of the door and a support element positioned on an inside of the door, the door grip being swivel-mounted on the support element through the outer shell of the door, comprising:

actuating a release lever inside the door in order to open a door lock by way of a catch, provided on the door grip, upon opening movement of the door grip, said release lever being a part of a door lock positioned within the door, and performing a door grip return movement by way of a return lever swivel-mounted on the support element, said return lever being loaded with a spring device working in a return direction and impelling the door grip to perform said return movement in a direction opposite that of the opening movement, wherein the return lever for driving the door grip engages with only one side of the catch facing the door grip.

6. A process according to claim 5, wherein the power vehicle is a passenger vehicle.

* * * * *